US006564965B2

(12) United States Patent
Cost

(10) Patent No.: US 6,564,965 B2
(45) Date of Patent: May 20, 2003

(54) COIN DISPENSER AND DISPENSING MECHANISM

(75) Inventor: Evan John Cost, Audubon, PA (US)

(73) Assignee: Mars, Incorporated, McLean, VA (US)

( * ) Notice: Subject to any disclaimer, the term of this patent is extended or adjusted under 35 U.S.C. 154(b) by 57 days.

(21) Appl. No.: 09/832,495

(22) Filed: Apr. 11, 2001

(65) Prior Publication Data

US 2001/0055946 A1 Dec. 27, 2001

(30) Foreign Application Priority Data

Apr. 12, 2000 (GB) ..... 0009075

(51) Int. Cl.[7] ..... B65H 1/00
(52) U.S. Cl. ..... 221/133; 453/41
(58) Field of Search ..... 453/40, 41, 49; 221/130, 132, 133, 273, 275

(56) References Cited

U.S. PATENT DOCUMENTS

| | | | | | |
|---|---|---|---|---|---|
| 792,923 | A | * | 6/1905 | Porter | 221/133 |
| 1,036,645 | A | * | 8/1912 | Kleinbaum | 453/41 |
| 2,782,791 | A | * | 2/1957 | Sigo | 453/40 |
| 3,783,885 | A | | 1/1974 | Williams et al. | |
| 4,606,362 | A | * | 8/1986 | Kobayashi et al. | 453/41 |
| 4,687,089 | A | | 8/1987 | Wuethrich | |
| 5,011,456 | A | | 4/1991 | Kobayashi et al. | |
| 5,595,535 | A | | 1/1997 | Wenskus | |
| 5,616,075 | A | * | 4/1997 | Winstanley et al. | 453/41 |
| 5,645,477 | A | * | 7/1997 | Satoh et al. | 453/40 |

FOREIGN PATENT DOCUMENTS

| | | | | | |
|---|---|---|---|---|---|
| EP | 0 173 119 | A1 | | 3/1986 | |
| EP | 0 903 702 | A2 | | 3/1999 | |
| GB | 2 032 403 | A | * | 5/1980 | 453/40 |
| JP | 406020146 | A | * | 1/1994 | 221/133 |
| JP | 406024401 | A | * | 2/1994 | 221/133 |
| JP | 406162303 | A | * | 6/1994 | 453/41 |

* cited by examiner

*Primary Examiner*—Kenneth W. Noland
(74) *Attorney, Agent, or Firm*—Fish & Richardson P.C.

(57) ABSTRACT

A coin dispenser includes coin storage tubes (4) each with a dispensing mechanism (10) located directly below each tubes (4). The dispensing mechanism (10) includes a motor (14), a planetary, planocentric or other compact reduction gear and a dispensing link arm (30) pivoted towards one side of the tube (4) and reciprocated by a drive pin (28) located in a slot (33). This arrangement allows a high packing density of tubes (4) and flexibility in their positioning. The tubes are arranged in an arc around a dispensing aperture (5). Multiple such dispensers may be stacked so that coins from an upper dispenser fall through the dispensing aperture in the lower dispenser.

16 Claims, 5 Drawing Sheets

COIN DISPENSER AND DISPENSING MECHANISM

BACKGROUND OF THE INVENTION

The present invention relates to a coin dispensing mechanism, particularly but not exclusively for dispensing coins laterally from an end of a stack. The present invention further relates to a coin dispenser having a plurality of such tubes and coin dispensing mechanisms.

An example of a coin dispenser with lateral dispensing tubes is described in U.S. Pat. No. 5,595,535. This dispenser has a motor and drive mechanism which can dispense coins from either of two adjacent tubes. However, the layout of the drive mechanisms of this and other prior art dispensers places a limit on the packing density of coin tubes in the dispenser. As a result, the coin capacity of such a dispenser of fixed total volume is limited. Moreover, the possible relative positions of the coin tubes are limited by such mechanisms, giving reduced flexibility in the overall design of the dispenser.

Another example is disclosed in EP-A-903702. This dispenser has an electric motor, planetary gear mechanism and dispensing disc, with holes for receiving coins arranged around its circumference, all coaxially arranged. Although this device aims to reduce the horizontal extent of the dispensing mechanism, the dispensing disc imposes a horizontal spacing between the coins and the motor and gear mechanism.

STATEMENT OF THE INVENTION

According to one aspect of the present invention, there is provided a coin dispensing mechanism for dispensing coins laterally from a tube, comprising a dispensing member for engaging a coin and dispensing it from the tube, a motor and a drive mechanism for connecting the motor to the dispensing member, the motor and drive mechanism being substantially bounded by the projection of the outer walls of the tube along the axis of the tube. Preferably, the motor is aligned substantially coaxially with the tube.

An advantage of this arrangement is that the relative positions of the tubes within a housing or bounded area can be selected freely, subject only to allowing room for coins to be dispensed from the tube. Another advantage is that the tubes can be positioned close together without their drive mechanisms and/or motors impinging on each other.

According to another aspect of the invention, there is provided a coin dispenser comprising a plurality of coin storage tubes, and a respective plurality of motors each associated with a respective one of the tubes so as to dispense coins only from the associated tube. An advantage of this arrangement is that the relative positions of two or more tubes are not governed by any common drive mechanism.

According to another aspect of the present invention, there is provided a coin dispenser having a dispensing aperture, and a plurality of coin storage tubes arranged such that the intersections of their axes with a horizontal plane lie on an arc, the tubes having lateral dispensing slots arranged approximately equidistantly from the edge of the dispensing aperture. This arrangement may provide efficient packing of the tubes around the dispensing aperture.

BRIEF DESCRIPTION OF THE DRAWINGS

Specific embodiments of the present invention will now be provided with reference to the accompanying drawings, in which.

MODES FOR CARRYING OUT THE INVENTION

Figure 1:
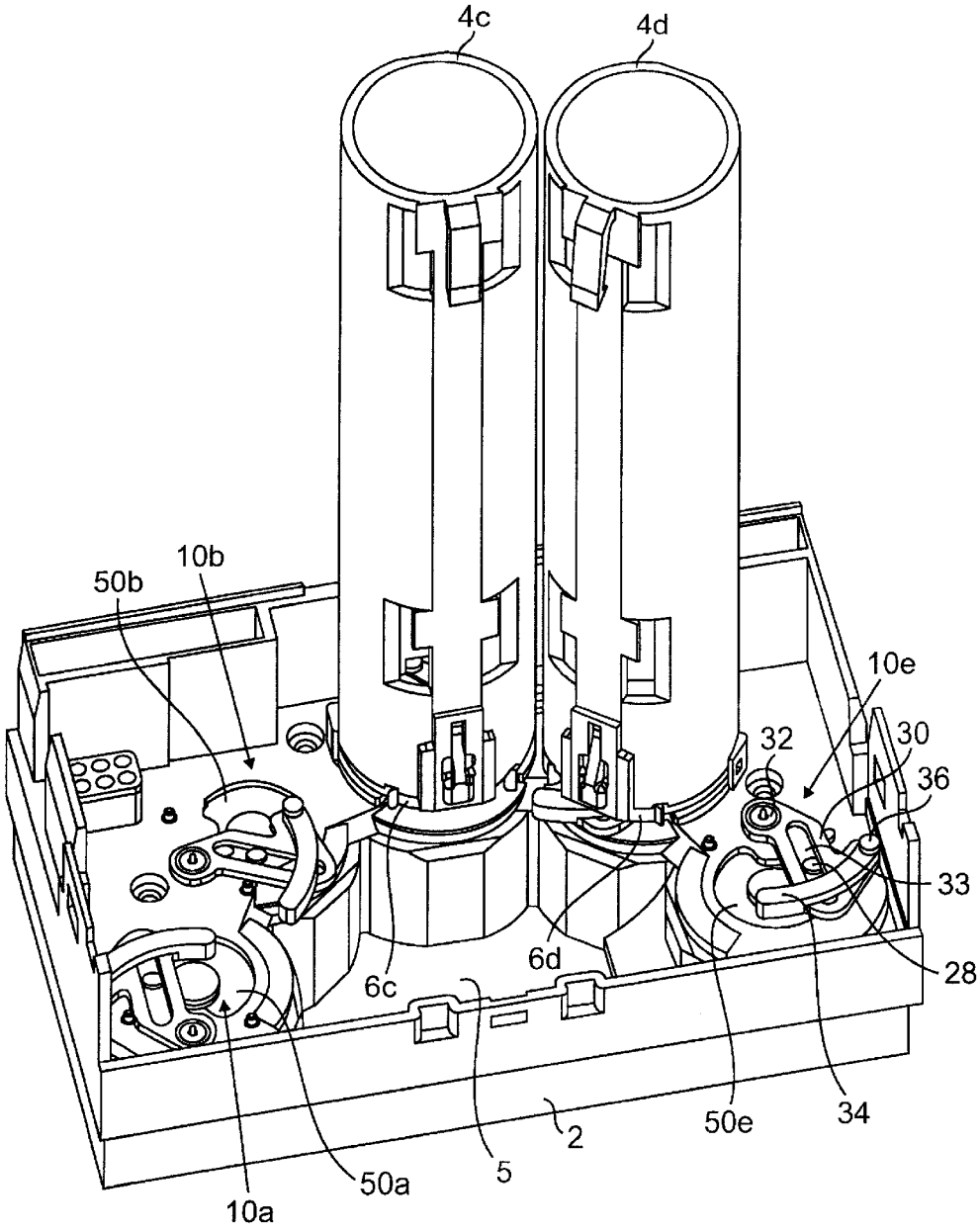
FIG. 1 shows a perspective view from above of the relevant parts of a coin dispenser in a first embodiment of the present invention.

As shown in FIG. 1, a coin dispenser has a base 2 carrying a plurality of coin storage tubes 4*a* and 4*e* arranged around the edge of a dispensing aperture 5. Only two of the storage tubes 4*c* and 4*d* are shown in place in this Figure. At the bottom of each of the storage tubes 4*a* to 4*e* is a coin dispensing slot 6*a* to 6*e* from which coins can be dispensed laterally. The coin dispensing slots 6 all face towards the dispensing aperture 5 so that coins (not shown) passing out of one of the coin dispensing slots 6 fall through the dispensing aperture 5 under the force of gravity. The tubes 4 are arranged in an arc on three sides of the dispensing aperture.

Figure 2:
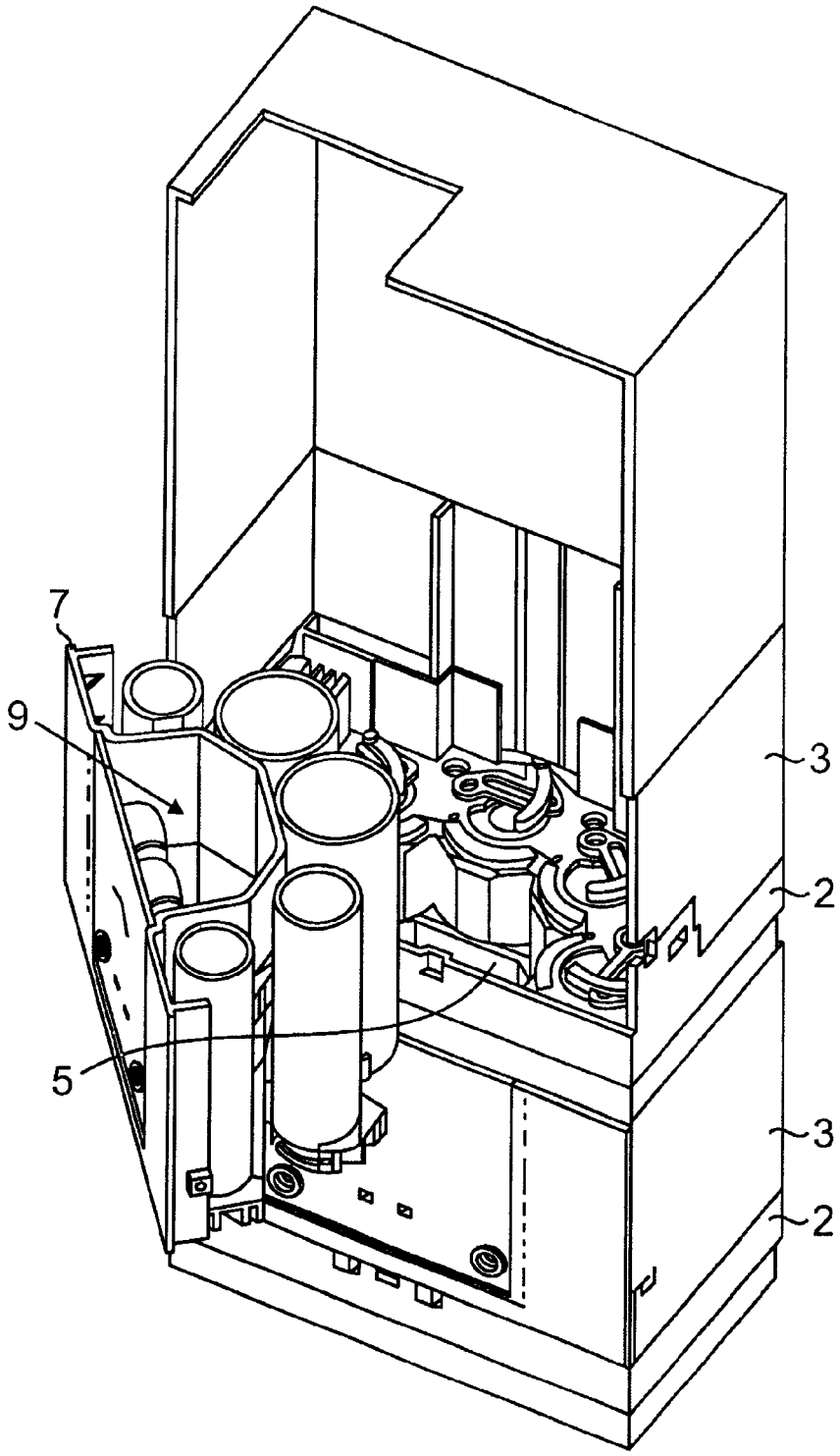
FIG. 2 shows a perspective view of the coin dispenser and its housing, mounted above a similar coin dispenser.

As shown in FIG. 2, the coin dispenser includes a housing 3 which is attached to the base 2 and surrounds the coin tubes 4. One side of the housing 3 is open to allow the coin tubes 4, mounted on a cassette 7, to be loaded and removed. The top of the housing 3 is also open.

The cassette 7 has a vertical passage 9 of similar horizontal cross-section to the dispensing aperture 5. This arrangement allows multiple coin dispensers to be stacked, as shown for example in FIG. 2, to give a coin dispenser of greater capacity, with coins dispensed by an upper coin dispenser falling through the vertical passage of a lower coin dispenser and passing through the dispensing aperture 5 thereof.

The coins are dispensed one-by-one from the bottom of the coin storage tubes 4 by respective dispensing mechanisms 10*a* to 10*e* controlled by electronic control circuitry (not shown). Each dispensing mechanism 10 is located directly under its associated tube 4 and projects very little outwards from under the tube 4 in its rest position. In its dispensing position, the dispensing mechanism 10 projects outwards in the dispensing direction so as to support the dispensed coin.

One or more additional dispensing mechanisms 10 and associated tubes 4 may be provided as an add-on component separate from the cassette 7 and base 2. This add-on component may be attached to a side of the housing 3 other than the open side into which the cassette 7 is inserted. The add-on component is preferably controlled by the electronic control circuitry in concert with the dispensing mechanisms 10*a* to 10*e* integrated with the base 2. A separate dispensing path may be provided for coins dispensed by the add-on component into the dispensing area, or the dispensing area may extend directly below the add-on component so that the coins drop down into it directly.

Figure 3:
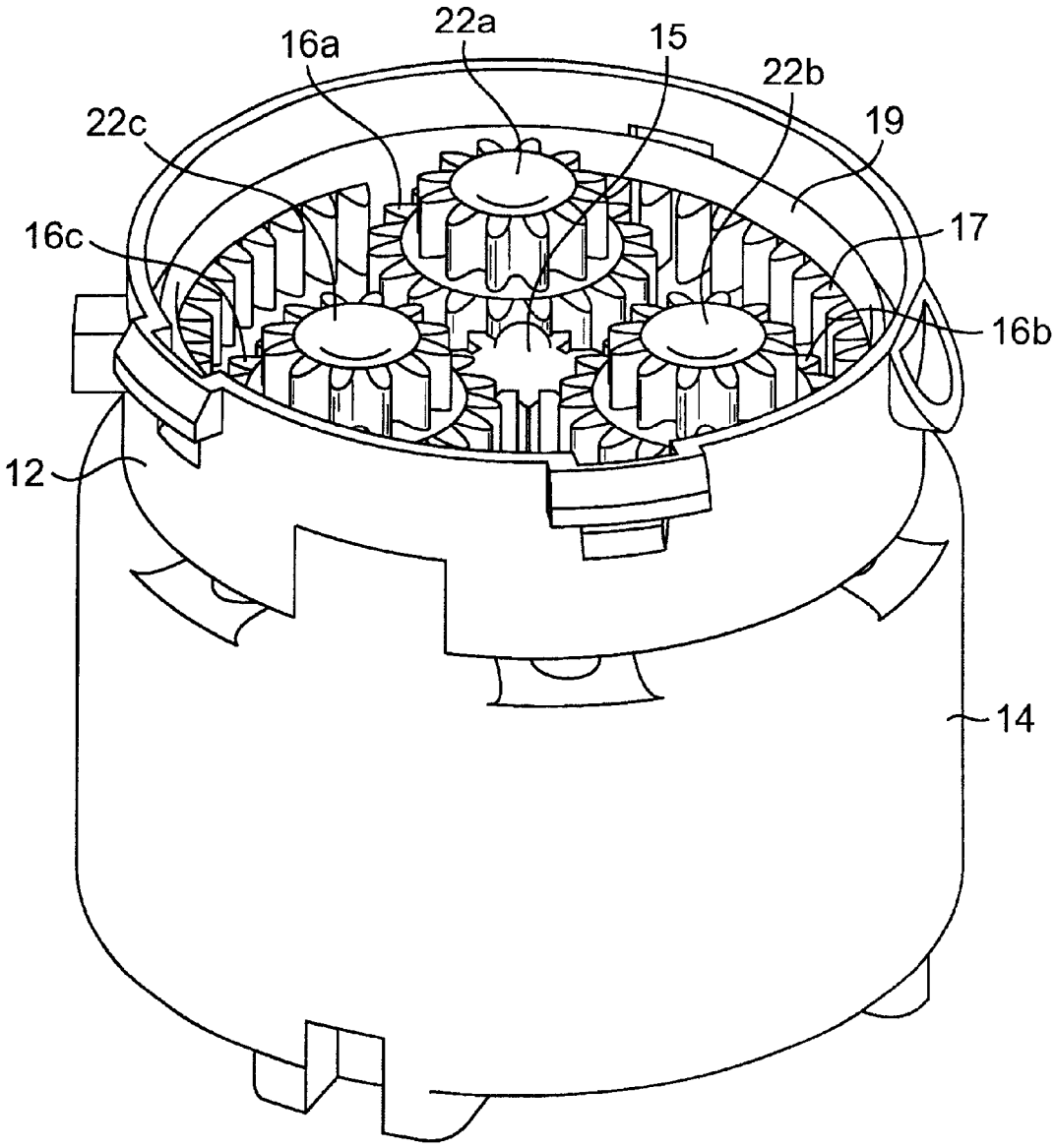
FIG. 3 shows a perspective view of the sun and planet gears of a drive mechanism of the coin dispenser.
Figure 4:
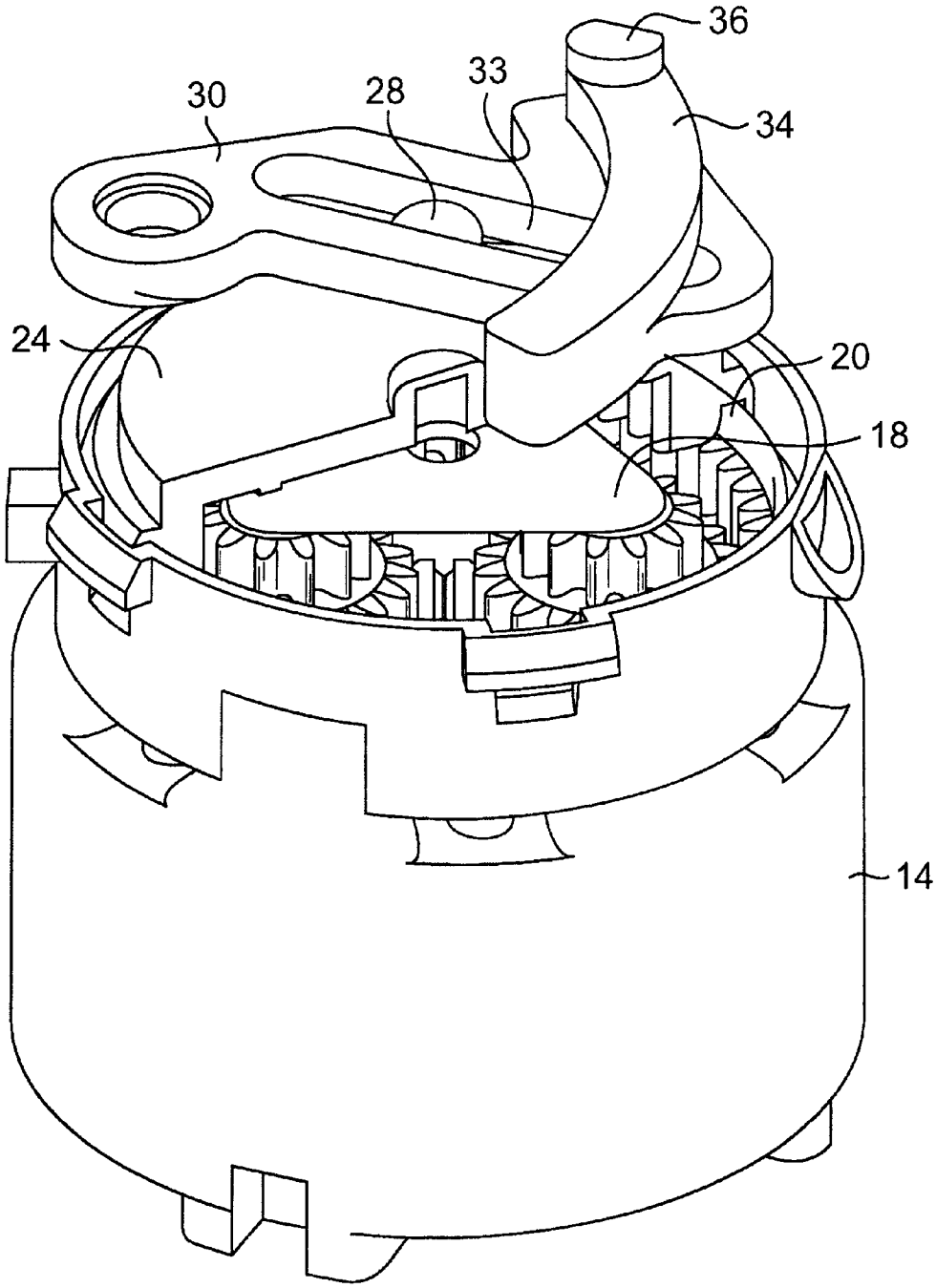
FIG. 4 shows a partially cut-away view of the complete drive mechanism of the first embodiment.

The dispensing mechanism 10 is shown in more detail in FIGS. 3 and 4. A gear casing 12, which may form part of or be removably attached to the base 2, is located above a compact cylindrical electric motor 14, for example Mabuchi Motor™ part no. RF-300PA-11400. This motor has a speed at maximum efficiency of 2400 RPM and therefore needs a high reduction ratio to provide a suitable speed and power for dispensing a coin. A dual planetary gear train provides this reduction without extending outside the axial projection of the tube 4.

In the first planetary gear train, a first sun gear 15 drives three equally angularly spaced first planet gears 16*a* to 16*c*. The first planet gears 16 engage a first gear cage 17. The first gear cage 17 is fixed with respect to the casing 12, and has an upwardly extending circumferential lip 19.

The first planet gears 16*a* to 16*c* are axially fixed to respective second planet gears 22*a* to 22*c*. As shown in FIG. 4, the first and second planet gears are axially rotatably attached to an equilateral triangular plate 18, which maintains the equiangular spacing of the planet gears. The second planet gears 22 engage a second gear cage 24 which is rotatable with respect to the casing 12 and the first gear cage 17, and has an outer circumferential groove 20 into which the lip 19 is located, allowing the second gear cage 24 to rotate coaxially with the first gear cage 17. The upper surface of the second gear cage 24 carries an upwardly-projecting drive pin 28 which engages a dispensing link arm 30.

The dual planetary gear train reduces the rotational speed of the motor of 2400 RPM to a rotational speed of the drive pin 28 of approximately 120 RPM or greater to allow coins to be dispensed from a single tube at a rate of at least one per second.

As shown in FIGS. 1 and 4, the dispensing link arm 30 is pivoted about a pin 32 which is formed as a projection of the casing 12 or base, and may be located adjacent a side of the storage tube 4. In a lower layer of the dispensing link arm 30 is a slot 33 within which the drive pin 28 slides so that the dispensing link arm 30 reciprocates in the dispensing direction when the second gear cage 24 rotates. In fixed connection to the lower layer is an upper layer having a support section 34, on which the bottom coin in the tube 4 rests, and a pusher pin 36 which is housed in its rest position in a recess in the side wall of the tube 4 so that it does not project into the internal volume of the tube. When the dispensing link arm 30 moves towards the dispensing slot 6, the pusher pin 36 abuts the edge of the bottom coin to be dispensed and pushes it towards the dispensing slot 6 so as to dispense the coin through the dispensing aperture 5.

The base 2 as shown in FIG. 1 has apertures 50*a* to 50*e* which allow the drive pin 28 of each dispensing mechanism 10 to rotate through a limited arc in which the mechanical advantage of the drive mechanism is high. A sensor (not shown) detects when the drive pin 28 reaches either end of the arc and abuts the base 2. The sensor may comprise a microswitch at either end of the arc, or may be connected to the current supply circuit of the motor 14 so as to detect the increased load on the motor caused by the drive pin 28 abutting the base 2. When the drive pin 28 reaches the clockwise extreme of the arc, as seen from above the base 2, a controller (not shown) reverses the voltage applied to the motor 14 to retract the dispensing link arm 30. When the anticlockwise extreme is reached, the voltage is reversed only when the next coin is to be dispensed.

In an alternative embodiment, the apertures 50*a*–50*e* allow complete rotation of the drive pins 28 and a rotational position sensor detects whether the dispensing mechanism 10 has reached the fully extended or fully retracted position, the controller then determining whether to reverse or disconnect the voltage supplied to the motor 14.

The dual planetary gear mechanism described above is just one example of a compact reducing gear mechanism which extends as little as possible away from the axis of the motor. Alternative planetary and other gear arrangements can be used in other embodiments of the present invention.

Figure 5:
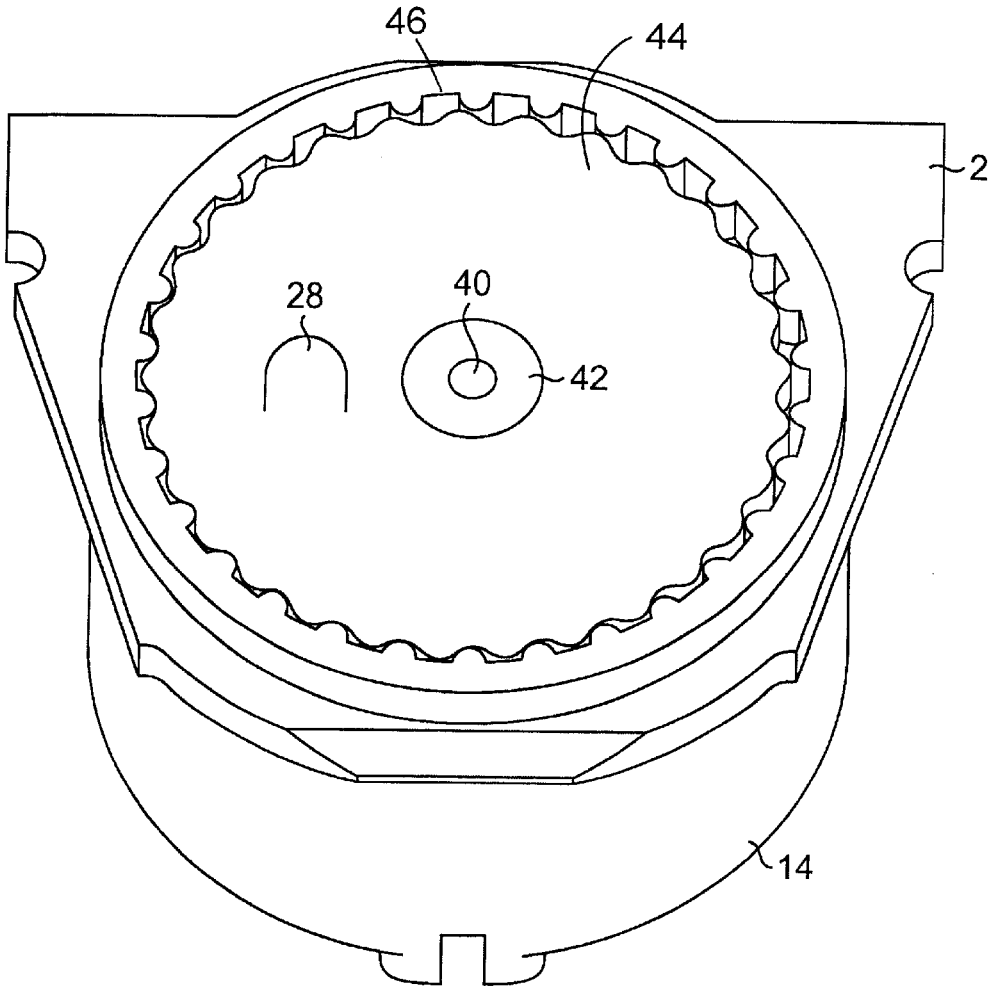
FIG. 5 shows a perspective view from above of one of the drive mechanisms of the coin dispenser in a second embodiment.

FIG. 5 shows an alternative gear mechanism for driving the dispensing link arm 30, in which a planocentric gear is used to provide a single stage gearing reduction. The axle 40 of the motor 14 is fixed off-center to a circular eccentric member 42 which is rotatably mounted concentrically within a planocentric gear 44 having 29 teeth. The planocentric gear 44 rotates around a gear cage 46 which has 30 teeth and is fixed relative to the base 2, driven by the eccentric member 42, to give a reduction factor of 30 in the rotation of the drive pin 28 around the axle 40.

The term 'coin' as used herein includes tokens and the like, and includes polygonal, non-circular coins such as the UK 50 and 20 pence pieces. The storage tubes for these coins may be correspondingly polygonal cylinders. Hence, the term 'cylindrical' does not imply that the tubes are circular cylinders. Moreover, the axes of the tubes could be at an angle to the plane of the dispensing end of the tube, so that the term 'cylindrical' does not imply a right cylinder.

The coin storage tubes may be filled from coins deposited in a coin acceptance mechanism, or may be pre-loaded by the operator.

The coin storage tubes need not dispense from the bottom, with the stack moving up to the dispensing end under the force of gravity; instead, the stack could be urged towards a dispensing end at the top of the stack, for example by a spring at the bottom of each tube.

The term 'motor' as used herein refers broadly to any type of device which converts another form of energy into mechanical kinetic energy, including without limitation a pulsing or rotary solenoid.

The above description relates to a coin dispenser which may be incorporated in a complete vending, changing, deposit or other machine. Details of such machines are omitted but will be understood by the skilled reader to be implicit in the above description.

The above embodiments are described purely by way of example, and alternatives or variants may be envisaged, which nevertheless fall within the spirit and scope of the present invention.

What is claimed is:

1. Coin dispensing apparatus, comprising:

a coin store for storing a stack of coins;

a dispensing member for removing a coin from an end of the stack in a dispensing direction;

a drive mechanism for driving the dispensing member between a rest position and a dispensing position; and wherein the drive mechanism and the dispensing member are located substantially within a volume bounded by a longitudinal projection of said end of the stack when the dispensing member is in the rest position and the dispensing member in the dispensing position projects outwardly from the volume in the dispensing direction.

2. Apparatus as claimed in claim 1, wherein the drive mechanism includes a rotary motor of which a projection of an axis of rotation falls within the stack.

3. Apparatus as claimed in claim 2, wherein the motor is aligned substantially coaxially with the stack.

4. Coin dispensing apparatus, comprising:

a store for storing a stack of coins;

a dispensing member for removing a coin from an end of the stack; and a drive mechanism for driving the dispensing member;

wherein the drive mechanism includes a rotary motor, of which the projection of an axis of rotation falls within the stack; and wherein the dispensing member is pivotable about an axis located substantially within a volume bounded by the longitudinal projection of said end of the stack.

5. Apparatus as claimed in claim 4, wherein the stack is cylindrical and aligned substantially coaxially with the rotary motor.

6. Apparatus as claimed in claim 1 or claim 4, wherein the drive mechanism includes a planetary gear mechanism.

7. Apparatus as claimed in claim 1 or claim 4, wherein the drive mechanism includes a planocentric gear mechanism.

8. Apparatus as claimed in claim 1 or claim 4, wherein the dispensing member is pivotable about an axis adjacent a side of the store.

9. Apparatus as claimed in claim 1 or claim 4, wherein the dispensing member includes an elongate slot and is driven by a pin located in the slot.

10. Apparatus as claimed in claim 1 or claim 4, wherein the dispensing member includes a pusher portion arranged to abut an edge of a coin so as to push the coin from the stack.

11. Apparatus as claimed in claim 10, wherein the side of the store includes a recess within which the pusher portion is locatable.

12. Apparatus as claimed in claim 1 or claim 4, wherein the dispensing member has a support surface for supporting the coin to be dispensed.

13. A coin dispensing device, comprising:

a plurality of coin stores each for storing a stack of coins, a respective plurality of dispensing mechanisms each for dispensing coins from the corresponding one of the coin stores, and a respective plurality of motors each for driving the corresponding one of the dispensing mechanisms; and wherein each of the plurality of motors is located substantially within a volume bounded by a longitudinal projection of an end of a corresponding one of the stacks.

14. A coin dispensing device, comprising:

a housing;

a coin store within the housing;

an aperture extending from an upper opening of the housing to a lower opening thereof; and means for dispensing coins from the coin store into said aperture.

15. A plurality of devices each as claimed in claim 14, stacked such that coins dispensed by an upper one of the devices are able to fall through the aperture of a lower one of the devices.

16. A coin dispensing device having a plurality of coin storage tubes positioned in an arc in the horizontal plane adjacent a coin dispensing aperture in the device each of the coin storage tubes having a dispensing mechanism for dispensing coins stored in the coin storage tube into the coin dispensing aperture.

* * * * *